United States Patent [19]

van Esdonk

[11] 4,066,923

[45] Jan. 3, 1978

[54] COLOR SELECTION LENS ELECTRODES CONNECTED BY DIFFUSION BONDS

[75] Inventor: Johannes van Esdonk, Eindhoven, Netherlands

[73] Assignee: U.S. Philips Corporation, New York, N.Y.

[21] Appl. No.: 759,111

[22] Filed: Jan. 13, 1977

[30] Foreign Application Priority Data

Jan. 16, 1976 Netherlands ..... 7600419

[51] Int. Cl.[2] ..... H01J 29/07; H01J 19/30

[52] U.S. Cl. ..... 313/402; 313/355; 313/403

[58] Field of Search ..... 313/402, 403, 355, 329, 313/352

[56] References Cited

U.S. PATENT DOCUMENTS

| | | | |
|---|---|---|---|
| 3,051,861 | 8/1962 | Ridgeway | 313/329 X |
| 3,297,902 | 1/1967 | Beggs | 313/355 X |
| 3,777,206 | 12/1973 | Armstrong | 313/402 X |

*Primary Examiner*—Robert Segal
*Attorney, Agent, or Firm*—Frank R. Trifari

[57] ABSTRACT

In a color display tube of the post focusing type the color selection means comprise a first and a second system of lens electrodes. A lens electrode belonging to the first system is connected by means of a diffusion bond to one of the metallized sides of an electrically insulating member which is metallized on two sides. A lens electrode belonging to the second system is formed either by the other metallized side of the insulating member or is secured to said other metallized side of the insulating member also by means of a diffusion bond. The color selection means are manufactured by starting from an insulating foil which is metallized on two sides and which is connected on the one side by a diffusion connection to each lens electrode belonging to the first system and which is provided on the other side with each electrode belonging to the second system, the desired apertures in the color selection means being obtained by locally etching away at least the metallized foil by means of a selective etching process.

7 Claims, 8 Drawing Figures

COLOR SELECTION LENS ELECTRODES CONNECTED BY DIFFUSION BONDS

Figure 1:
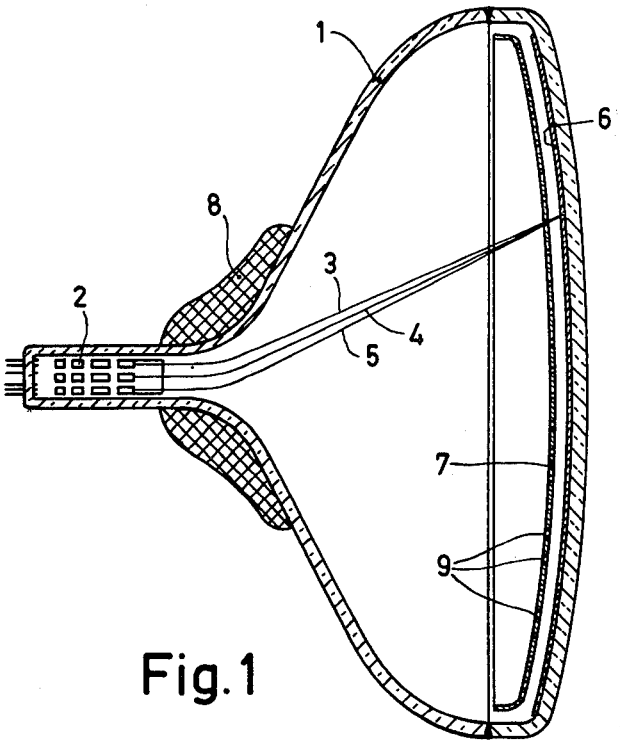

The invention relates to a colour display tube comprising in an evacuated envelope means to generate a number of electron beams, a display screen comprising a large number of regions luminescing in different colours, and colour selection means comprising a large number of apertures which assign each electron beam to luminescent regions of one colour, which colour selection means comprise a first and a second system of lens electrodes, a lens electrode belonging to the first system being electrically insulated from a lens electrode belonging to the second system by means of an insulating member.

The invention furthermore relates to a method of manufacturing such a colour display tube.

In colour display tubes, colour selection means are usually used in the form of a perforated plate which is arranged at a short distance before the display screen and which is often referred to by the name of shadow mask. The drawback of such a mask is that a great part, for example 80 to 85%, of the electrons is intercepted, which imposes restrictions upon the maximum achievable brightness of the displayed picture. It is known to increase the brightness of the displayed picture by enlarging the apertures in the colour selection means and postfocusing the electron beams.

Such a colour display tube of the postfocusing type is known from the U.S. Pat. No. 3,398,309. In said patent specification, a lens of the unipotential type is formed in each of the apertures of the colour selection means.

It is an object of the invention to provide a colour display tube of the postfocusing type having colour selection means of a simple construction.

A further object of the invention is to provide a method according to which said colour selection means can be manufactured in a simple manner.

According to the invention, a colour display tube in which the colour selection means comprise a first and a second system of electrodes in which a lens electrode belonging to the first system is electrically insulated from a lens electrode belonging to the second system by means of an insulating member, is characterized in that the insulating member consists of a member which is metallized on two sides of which one metallized side is secured to lens electrodes belonging to the first system by means of a diffusion bond and lens electrodes belonging to the second system are present on the other metallized side of the insulating member. A diffusion bond is a bond between two metals and is produced by pressing said metals against each other and heating them to a temperature below the melting temperature of the two metals. This known bonding technique is not restricted to the use of two different metals but may also be used for bonding two the same metals. A few examples of metals which are suitable for such a bond are copper, gold, aluminium, nickel, tin and lead.

In a particular embodiment of a colour display tube according to the invention the said other metallized side of the insulating member forms lens electrodes belonging to the second system.

In another embodiment the said other metallized side of the insulating member is also connected to lens electrodes belonging to the second system by means of a diffusion bond.

The insu!ating member preferably consist of a synthetic material, and in particular of a polyimide. Such a synthetic material should, of course, be thermally resistant upto that temperature at which the diffusion bond is realized and also to those temperatures to which the tube is exposed after assembling the colour selection means in the tube.

In a preferred embodiment of a tube according to the invention the colour selection means consist of a metal plate which has a large number of apertures arranged in rows and a set of parallel conductive strips which are positioned between the rows of apertures. The grid is insulated from the plate in the above-described manners by means of insulating members. According to a first possibility, the said first system of lens electrodes may be formed by the metal plate and the said second system of lens electrodes may be formed by the conductive strips. According to a second possibility, the first system of lens electrodes is formed by the conductive strips and the second system of lens electrodes is formed by the conductive plate.

In another embodiment of a tube according to the invention the colour selection means consist of a frame formed by two sets of parallel conductors crossing each other, which conductors are electrically insulated from each other at the crossings by means of insulating members and in which the conductors of one and the same set are connected together electrically.

According to these latter embodiments, a quadrupole lens is formed in each of the apertures of the colour selection means upon applying a voltage difference between the first and the second system of lens electrodes. The electric field in each of the apertures is at right angles to or substantially at right angles to the electron beams passing through it. The colour selection means constructed according to the invention have the advantage as compared with those according to the United States patent specification of being operable with a lower voltage difference because a quadrupole lens is comparatively stronger than a unipotential lens. That a quadrupole lens focuses in one direction and defocuses in a direction at right angles thereto is no drawback in principle, when the luminescent regions on the display screen have the form of substantially parallel strips the longitudinal direction of which is parallel to the defocusing direction of the quadrupole lenses.

According to a simple method the colour selection means are obtained by starting from insulating foil which is metallized on two sides and which is connected on one side to each lens electrode belonging to a first system by a diffusion bond and which on the other side is provided with each lens electrode belonging to a second system, the desired apertures in the colour selection means being obtained by locally etching away the metallized foil by means of a selective etching method.

According to an embodiment of said method, each lens electrode belonging to the second system is connected to the other metallized side of the foil by means of a diffusion bond.

According to this method, colour selection means are preferably manufactured which form a quadrupole lens in each aperture for post fucusing the electron beams. This is realized when all the lens electrodes belonging to the first system are formed by a metal plate in which apertures arranged in rows are provided and all the lens electrodes belonging to the second system are formed by a number of conductive strips which are positioned between the rows of apertures and which are connected together electrically.

This is realized in a different manner when a foil which is metallized on two sides is connected on one side by a diffusion bond to a first grid of parallel metal strips which are connected together electrically, and is connected on the other side by a diffusion bond to a second grid of parallel metal strips which are connected together electrically, the first grid crossing the second grid and the desired apertures in the colour selection means being obtained by etching away the metallized foil between the strips belonging to the same grid by means of a selective etching process.

The colour selection means can be adapted to the desired shape of the display screen. In the case in which the first system of lens electrodes is formed by a metal plate, this can be realized by starting from a cylindrically curved plate. In the case of two crossed grids, this can be realized by the crosswise arrangement of the first and the second grid over a mould having a cylindrical surface, the ends of the grids each being clamped in clamping members secured on a common base plate, which base plate has a larger coefficient of thermal expansion than the grid, the assembly being then heated in a furnace to a temperature at which, as a result of the difference in expansion between the grids and the base plate, the grids are streched to beyond their limit of elasticity and a diffusion bond is produced between the grids and the metallized sides of the insulating foil, the metallized foil being finally etched away between the strips belonging to the same grid by means of a selective etching process.

Starting material for the manufacture of the colour selection means preferably is a metallized foil of synthetic material, in particular a polyimide foil.

Figure 2:
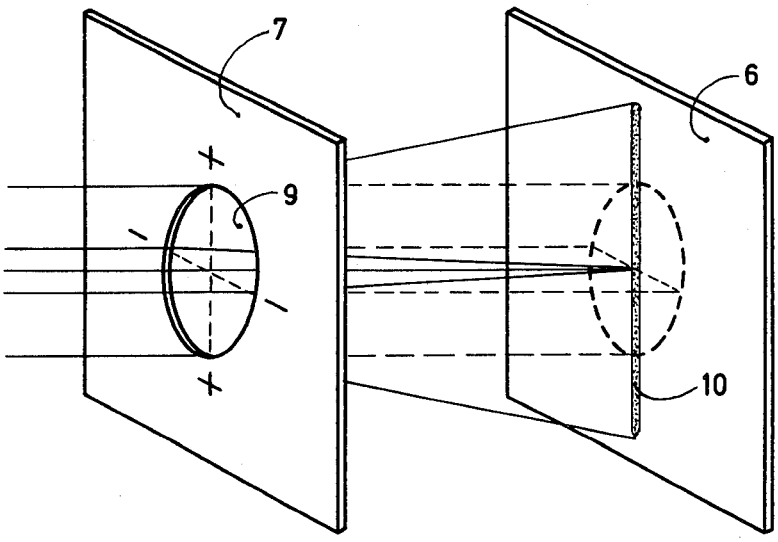
Figure 3A:
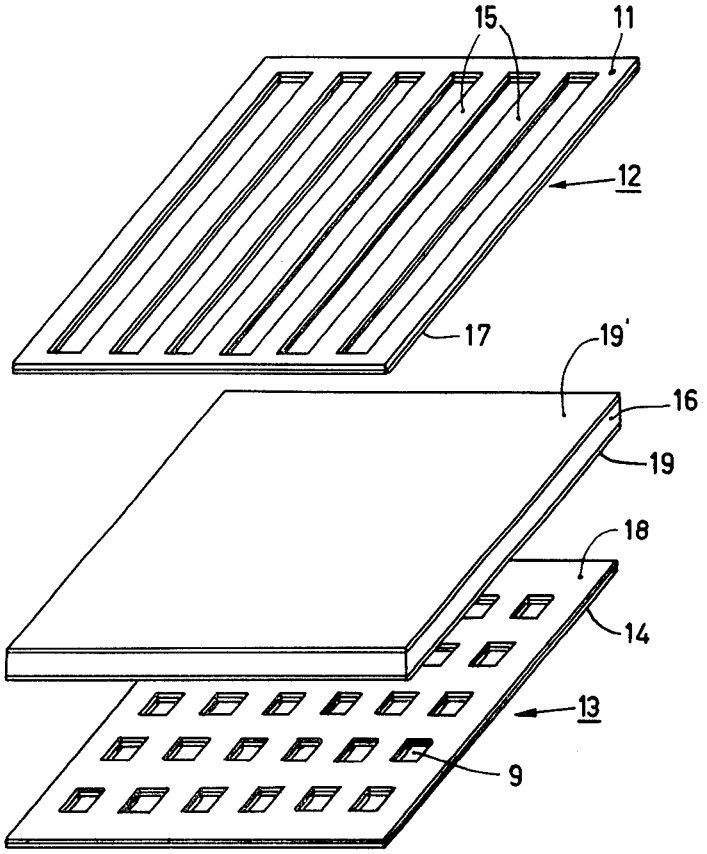
Figure 3B:
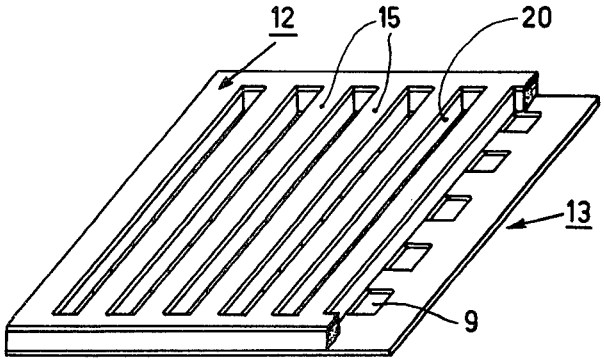
Figure 4:
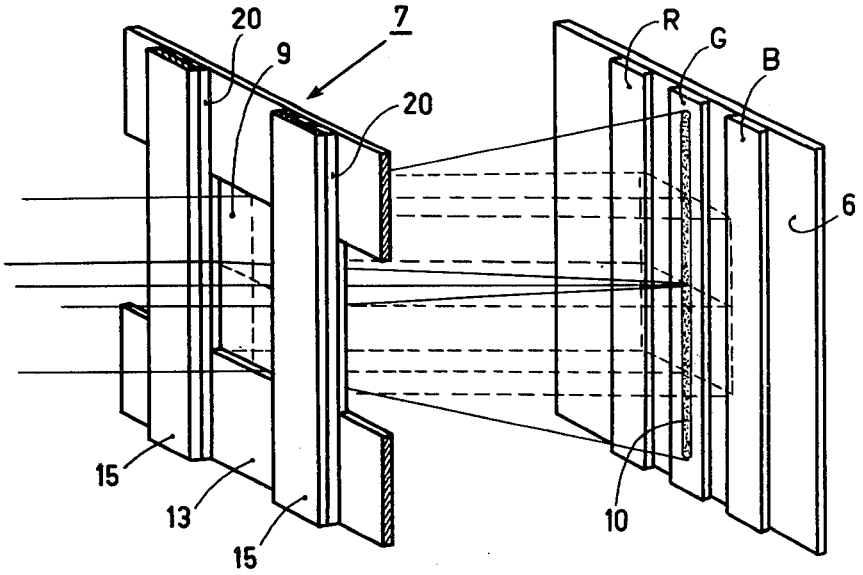
Figure 5:
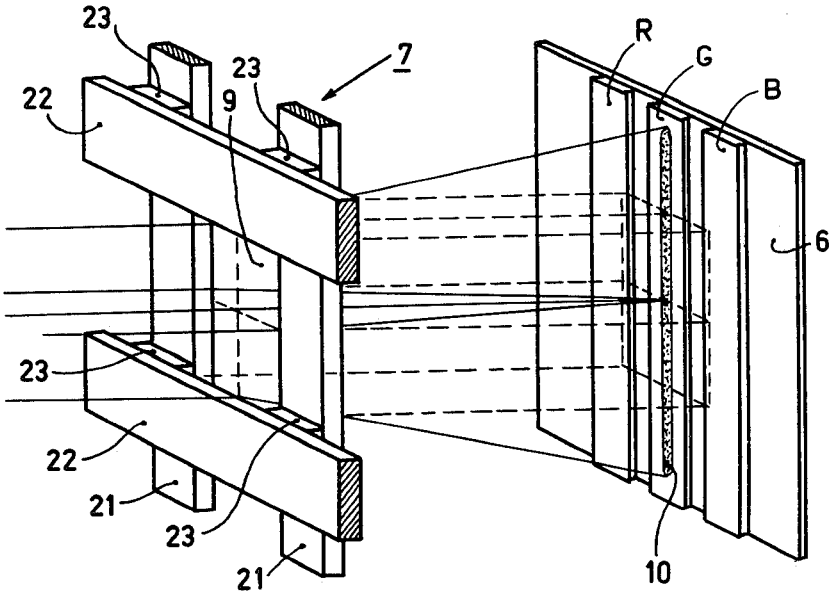
Figure 6:
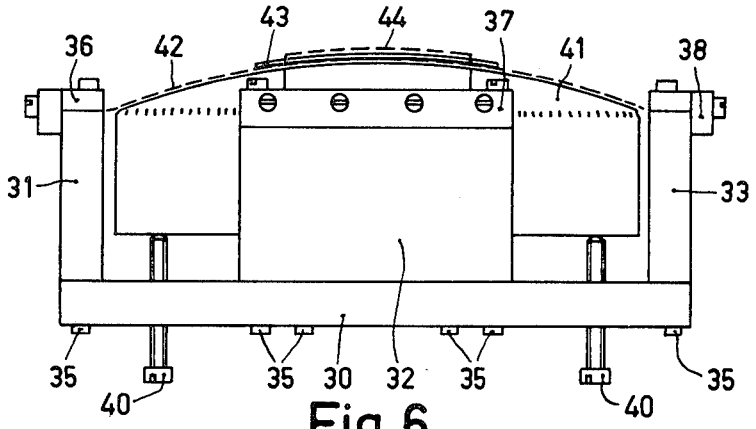
Figure 7:
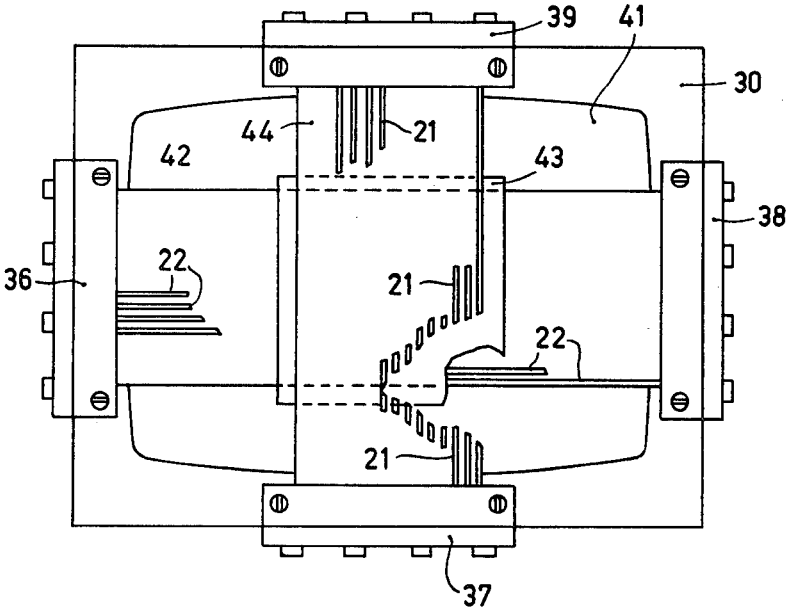

The invention will be described in greater detail with reference to the drawing, in which:

FIG. 1 is a horizontal sectional view of a colour display tube according to the invention:

FIG. 2 shows the principle of the post focusing effect of the quadrupole lenses, FIGS. 3*a, b* illustrate an embodiment of the method according to the invention, FIG. 4 shows a detail of the colour selection means shown in FIG. 3*b*, FIG. 5 shows a detail of another embodiment of the colour selection means, and FIGS. 6 and 7 show an embodiment of the method of manufacturing the colour selection means shown in FIG. 5.

The tube shown in FIG. 1 comprises a glass envelope 1, means 2 to generate three electron beams 3, 4 and 5, a display screen 6, colour selection means 7 and deflection coils 8. The electron beams 3, 4 and 5 are generated in one plane, the plane of the drawing of FIG. 1, and are deflected over the display screen 6 by means of the deflection coils 8. The display screen 6 consists of a large number of phosphor strips luminescing in red, green and blue and the longitudinal direction of which is at right angles to the plane of the drawing of FIG. 1. During normal operation of the tube the phosphor strips are vertical and FIG. 1 hence is a horizontal sectional view of the tube. The colour selection means 7 comprise a large number of apertures 9 which are shown diagrammatically in FIG. 1 only. The three electron beams 3, 4 and 5 pass through the apertures 9 at a small angle to each other and consequently impinge each only upon phosphor strips of one colour. The apertures 9 in the colour selection means 7 are hence very accurately positioned relative to the phosphor strips of the display screen 6.

FIG. 2 shows the principle of the post focusing effect of a quadrupole lens. Shown is a part of the colour selection means 7 and one of the apertures 9. The potential variation along the edge of the apertures 9 is denoted by +, −, +, − in such manner that a quadrupole lens is formed. The electron beam which passes through the aperture 9 is focused in the horizontally drawn plane and is defocused in the vertically drawn plane so that, when the display screen is exactly in the horizontal focus, the electron spot 10 is formed. As will be described hereinafter it is recommendable not to focus exactly on the display screen 6 so that slightly wider electron spot is formed. It is only of minor influence on the focusing when the electron beam passes through the aperture 9 at a small angle. The colour selection of the three electron beams 3, 4 and 5 takes place in a manner quite analoguous to that of the known shadow mask tube. As a result of the strong focusing, however, the aperture 9 may be much larger than in the known shadow mask tube, so that a far greater number of electrons impinges upon the display screen 6 and a brighter picture is obtained. The defocusing in a vertical direction need not be a drawback when phosphor strips are used which are parallel to the longitudinal direction of the spot 10.

A first embodiment of the colour selection means 7 will be described with reference to FIGS. 3*a* and 3*b*. The starting material for the manufacture of the colour selection means is a first iron plate 11, an insulating foil 16, and a second iron plate 14. The two plates 11 and 14 have a thickness of about 100 microns. By means of a known photoetching method, slots are etched in the plate 11 in such manner that a grid 12 of parallel strips 15 is obtained. The strips have a width of 0.26 mm and the slots have a width of 0.54 mm. Square holes 9 of 0.54 × 0.54 mm are etched in the second iron plate 14 with a pitch of 0.8 mm, so that an apertured plate 13 is obtained. The grid 12 and the apertured plate 13 are coated on one side with layers of gold 17 and 18, respectively, thickness 2 microns. With the coated sides facing each other, the grid 12 and the apertured plate 13 are pressed against an insulating foil 16 which is coated on both sides with a layer of copper 19 and 19'. The foil 16 has a thickness of about 125 microns and the copper layers 19 and 19' have a thickness of about 5 microns. A foil which is extremely suitable for this purpose consists of the polyimide of 1-2-4-5 benzenetetracarbonic acid dianhydride and 4-4' diaminodiphenyl ether. Such foils are commercially available as Kapton. Assembling the above-described parts can be effected in a pressure mould, it being ensured that the slots in the grid 12 are positioned above the apertures 9. By means of the pressure mould, the parts are pressed against each other at a pressure of approximately 1 kg/sq.cm and heated to a temperature of approximately 400°° C in a furnace under a neutral or reducing atmosphere. At this pressure and temperature, a diffusion bond is effected within a few minutes between the contacted copper layer 19 and gold layer 18 and copper layer 19' and gold layer 17, respectively. The uncovered parts of the copper layers 19 and 19' and then the consequently exposed parts of the polyimide foil 16 are etched away. For etching away the copper layers, a selective etchant is used which does not etch away the material of the grid or the plate. In the present case a chromic acid sulfuric acid bath may be used. A suitable etchant for the polyimide is hydrazine hydrate or a solution of approximately 10 *n* lye, preferably KOH. The product obtained after these steps is shown in FIG. 3*b*. The interconnected strips 15 form a second system of lens electrodes and are connected mechanically, by means of insulating rods 20, to the apertured plate 13 which forms the first system of lens electrodes.

It is not necessary to start from two metal plates. It is alternatively possible to etch a grid of parallel strips in the copper layer 19' by means of a photoetching method, the grid 12 being used as a negative. So in that case only the apertured plate 13 is bonded to the copper layer 19 by diffusion. Of course it is also possible in an analoguous manner to use the apertured plate 13 as a negative and to etch a pattern of holes in the copper layer 19 photographically. In that case only the grid 12 is bonded to the copper layer 19' by diffusion.

FIG. 4 shows on an enlarged scale a part of the colour selection means shown in FIG. 3*b* located around an aperture 9. The colour selection means can be operated at the following voltages for postfocusing the electron beams. At a potential of the display screen 6 of 25 kV, a potential of the plate 13 of likewise 25 kV and a potential of the conductive strips 15 of 23.4 kV, the focal distance of the quadrupole lenses is 18mm with perpendicular incidence in the centre of the display screen and 12.7 mm at the edge of the display screen where the electron beams are incident at an angle of about 37° to the normal of the display screen. The distance between the display screen 6 and the colour selection means is 15 mm in the centre of the display screen and 10 mm at the edge. In the centre of the display screen the electron spots are 0.10 mm wide and in the corners they are 0.09 mm wide and no focus ring is visible on the display screen. The width of the phosphor strips R, G and B is 0.13 mm. The remainder of the display screen may or may not be provided with a light-absorbing material.

FIG. 5 shows another embodiment of the colour selection means 7. The two systems of lens electrodes consist of grids of parallel metal strips having a thickness of 100 microns. Of the grid forming the first system of lens electrodes are shown two strips 21. Of the grid forming the second system of lens electrodes are shown two strips 22. The strips 21 and 22 cross each other at right angles and are connected together at the crossings with metallized insulating members 23 of the above-mentioned polyimide. The strips have a width of 0.24 mm and a mutual pitch of 0.8 mm so that the transmission of the colour selection means is approximately 50% and each of the apertures 9 forms a square of 0.56 × 0.56 mm. At a potential of the display screen 6 of 25 kV and a potential of the horizontal conductors 22 of 25.45 kV and of the vertical conductors 21 of 24.55 kV, the focal distance of the quadrupole lenses is 18.0 mm in the centre of the display screen with perpendicular incidence and 12.7 mm at the edge of the curved display screen where the electron beams are incident at an angle of 37° to the normal of the display screen. The distance of the colour selection means 7 to the display screen 6 is 15 mm in the centre and 10 mm at the edge, so that the focus of the quadrupole lenses is again everywhere just beyond the display screen so as to prevent that a so-called focus ring becomes visible on the display screen. The electron spots are again approximately 0.10 mm wide, so that a suitable width of the phosphor strips R, G and B is again 0.13 mm. The method of manufacturing said colour selection means will be described with reference to FIGS. 6 and 7. On a chromium-nickel steel base plate 30 having a coefficient of expansion of $175.10^{-7}$, four holders are secured by means of bolts 35 two by two opposite to each other, three of said holders being denoted by 33, 32 and 31. The holders comprise four clamping beaks 36, 37, 38 and 39. The base plate 30 furthermore comprises four adjusting bolts 40, two of which are shown, located at the corners of a rectangle. A moulded steel mould 41 having a coefficient of expansion of $100.10^{-7}$ and having a cylindrical surface bears on the adjusting bolts 40. A first grid 42 of parallel strips 22 copper-plated on one side is clamped at the end of the strips between the clamping beaks 36 and 38. A polyimide foil 43, thickness 125 micron, metallized on two sides with aluminium is laid over the strips 22. A second grid 44 of parallel strips 21 copper-plated on one side is clamped at the ends between the clamping beaks 37 and 39 so that the polyimide foil is located between the copper-plated surfaces of the two grids 42 and 44. The mould 41 is moved upwards by means of the adjusting bolts 40, the two grids 42 and 44 being stretched. The assembly is then heated in a furnace to a temperature of 400° C. The two grids are of a metal having a coefficient of expansion of approximately $100.10^{-7}$. As a result of the difference in expansion of the base plate 30 and the grids 42 and 44, the grids are stretched to beyond their elastic limits so that the grids assume a permanent deformation according to the cylindrical surface of the mould 41. Furthermore, in these circumstances the grids can be connected by means of diffusion bond to the metallized sides of the foil 43. After cooling, first the non-covered parts of the metallization and then the strips of polyimide foil between the strips 21 and between the strips 22 are etched away. The material at the crossings of the strips 21 and 22 is less readily accessible for the etchant liquid than the remaining part of the foil, so that colour selection means consisting of two grids connected together mechanically at the crossings are obtained having the construction as shown in FIG. 5. An additional advantage of the method is that the colour selection means need no longer be compressed to the desired shape, since said shape is obtained simultaneously with the connection of the grids to the metallized foil.

The desired geometric shape of the colour selection means shown in FIG. 4 can be obtained by starting from a cylindrical pre-shaped apertured plate and stretching a grid of parallel strips across the cylindrical surface of said plate and then bonding the apertured plate and the grid by diffusion to an intermediately clamped foil metallized on two sides.

Finally it is noted that preferably at least one of the systems of lens electrodes consist of a ferromagnetic material so as to screen the electron beams from the earthly magnetic field.

What is claimed is:

1. A colour display tube comprising in an evacuated envelope means to generate a number of electron beams, a display screen comprising a large number of regions luminescing in different colours, and colour selection means comprising a large number of apertures which assign each electron beam to luminescent regions of one colour, which colour selection means comprise a first and a second system of lens electrodes, a lens electrode belonging to the first system being electrically insulated from a lens electrode belonging to the second system by means of an insulating member, characterized in that the insulating member consists of a member which is metallized on two-sides of which one metallized side is connected to a lens electrode belonging to the first system by means of a diffusion bond and a lens electrode belonging to the second system is present on the other metallized side of the insulating member.

2. A colour display tube as claimed in claim 1, characterized in that the said other metallized side of the insulating member forms a lens electrode belonging to the second system.

3. A colour display tube as claimed in claim 1, characterized in that the said other metallized side of the insulating member is also connected to lens electrodes belonging to the second system by means of a diffusion bond.

4. A colour display tube as claimed in claim 1, characterized in that the said insulating member is a synthetic resin.

5. A colour display tube as claimed in claim 1, characterized in that the said insulating member is a polyimide.

6. A colour display tube as claimed in claim 1, characterized in that the colour selection means consist of a metal plate having a large number of apertures arranged in rows and a set of parallel conductive strips positioned between said rows and being connected together electrically and being connected mechanically to the plate by means of insulating members.

7. A colour display tube as claimed in claim 1, characterized in that the colour selection means consist of a frame formed by two sets of parallel conductors crossing each other, which conductors are electrically insulated from each other, at the crossings by means of insulating members and in which the conductors of one and the same set are connected together electrically.

* * * * *